US011029039B2

(12) United States Patent
Morita et al.

(10) Patent No.: US 11,029,039 B2
(45) Date of Patent: Jun. 8, 2021

(54) HEATING AND HOT WATER SUPPLYING DEVICE

(71) Applicant: NORITZ CORPORATION, Hyogo (JP)

(72) Inventors: Yasushi Morita, Hyogo (JP); Yoshihisa Kitano, Hyogo (JP); Yasutaka Kuriyama, Hyogo (JP); Hiroshi Morimoto, Hyogo (JP); Midori Yokoyama, Hyogo (JP); Haruhiko Tamada, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 37 days.

(21) Appl. No.: 16/349,278

(22) PCT Filed: Oct. 26, 2017

(86) PCT No.: PCT/JP2017/038649
§ 371 (c)(1),
(2) Date: May 13, 2019

(87) PCT Pub. No.: WO2018/096867
PCT Pub. Date: May 31, 2018

(65) Prior Publication Data

US 2019/0346153 A1 Nov. 14, 2019

(30) Foreign Application Priority Data

Nov. 25, 2016 (JP) ..... JP2016-228811

(51) Int. Cl.
*F24D 3/08* (2006.01)
*F24H 1/52* (2006.01)
(Continued)

(52) U.S. Cl.
CPC ..... *F24D 3/08* (2013.01); *F24D 19/1066* (2013.01); *F24H 1/48* (2013.01); *F24H 1/52* (2013.01);
(Continued)

(58) Field of Classification Search
None
See application file for complete search history.

(56) References Cited

U.S. PATENT DOCUMENTS 2,813,683 A * 11/1957 Dillman ..... F24D 3/087 237/8 C
3,426,971 A * 2/1969 Meier ..... F24D 19/1066 237/8 D
(Continued)

FOREIGN PATENT DOCUMENTS

AT 389755 B * 1/1990 ..... F24D 19/1069
CN 1912492 2/2007
(Continued)

OTHER PUBLICATIONS

"JP_2005337632_A_M—Machine Translation.pdf", Machine Translation, JPO.org (https://www.j-platpat.inpit.go.jp/), Jul. 6, 2020.*
(Continued)

*Primary Examiner* — Daniel E. Namay
(74) *Attorney, Agent, or Firm* — JCIPRNET

(57) ABSTRACT

A heating and hot water supplying device includes: a circulation passage that connects a heat exchanger and an external heating terminal; a bypass passage that bypasses the heating terminal by branching from the circulation passage; a hot water supply passage for supplying the hot water heated to a preset hot water supply temperature by the heat exchanger for hot water supply; a control unit that controls operations in which this plurality of units are used; and an operation terminal for performing various operations. A
(Continued)

distribution valve is provided in the branching portion of the bypass passage. The distribution valve adjusts the distribution ratio so that each of a heating operation, a hot water supplying operation, and a simultaneous heating and hot water supplying operation is possible. The operation terminal is provided with a prohibit switch to prohibit the simultaneous heating and hot water supplying operation.

4 Claims, 2 Drawing Sheets

(51) Int. Cl.
*F24H 1/48* (2006.01)
*F24D 19/10* (2006.01)
*F24H 9/20* (2006.01)

(52) U.S. Cl.
CPC ..... *F24D 19/1015* (2013.01); *F24D 19/1069* (2013.01); *F24D 2220/042* (2013.01); *F24H 9/2035* (2013.01)

(56) References Cited

U.S. PATENT DOCUMENTS 3,490,693 A * 1/1970 Meier ..... F23N 1/087 237/8 D
3,543,731 A * 12/1970 David ..... F24H 1/52 122/33
4,381,075 A * 4/1983 Cargill ..... G05D 23/24 236/46 R
5,730,356 A * 3/1998 Mongan ..... F24D 19/0092 237/19
5,881,952 A * 3/1999 MacIntyre ..... F24D 3/08 237/19
2004/0200905 A1* 10/2004 Saitoh ..... F24D 17/02 237/19
2005/0098643 A1* 5/2005 Guyer ..... F24D 5/02 237/12.1
2005/0161521 A1* 7/2005 Guyer ..... F24D 5/02 237/12.1
2008/0033651 A1* 2/2008 Inoue ..... F24H 1/523 702/3
2009/0090310 A1* 4/2009 Farrell ..... F24H 1/41 122/20 A
2009/0090789 A1* 4/2009 Zirkiyev ..... F24D 10/00 237/8 A
2009/0179079 A1* 7/2009 Ruijven ..... F24H 1/285 237/12.3 B
2009/0283057 A1* 11/2009 Kim ..... F24H 1/526 122/13.01
2009/0283249 A1* 11/2009 Min ..... F24H 9/0036 165/156
2010/0195991 A1* 8/2010 Deivasigamani .. G05D 23/1927 392/308
2011/0017152 A1* 1/2011 Min ..... F24D 19/1024 122/19.1
2012/0042673 A1* 2/2012 Noh ..... F24D 3/08 62/159
2012/0043390 A1* 2/2012 Noh ..... F24D 3/08 237/2 A
2012/0305105 A1* 12/2012 Min ..... F24D 3/087 137/337
2013/0047654 A1* 2/2013 Fukunaga ..... F24H 9/148 62/238.7
2013/0048745 A1* 2/2013 Johnson, Jr. ..... F01K 17/02 237/8 A
2015/0204550 A1* 7/2015 Deivasigamani ..... F24D 3/082 237/2 A
2015/0204577 A1* 7/2015 Son ..... F22B 1/16 122/14.1
2015/0300661 A1 10/2015 Park
2016/0017760 A1* 1/2016 Okaichi ..... F01K 23/04 60/655
2016/0033171 A1* 2/2016 Mase ..... F24H 1/145 122/14.3
2016/0178219 A1* 6/2016 Deivasigamani ..... F24D 3/08 237/19
2016/0313026 A1* 10/2016 Cool ..... F28F 7/02
2016/0320075 A1* 11/2016 Deivasigamani ..... F24D 3/08
2017/0023263 A1* 1/2017 Tamaki ..... F24D 3/08
2017/0234550 A1* 8/2017 Deivasigamani ..... F24F 5/0096 237/19
2018/0073748 A1* 3/2018 Gagne ..... F24D 3/08
2018/0073749 A1* 3/2018 Gagne ..... F24D 19/1069
2018/0149373 A1* 5/2018 Morita ..... F24D 3/02
2018/0195739 A1* 7/2018 Kawachi ..... F28F 9/0256
2019/0032959 A1* 1/2019 Tsuda ..... F24H 9/144
2019/0154303 A1* 5/2019 Kitano ..... F24D 19/1015
2019/0154304 A1* 5/2019 Kuriyama ..... F24H 9/2035
2019/0234653 A1* 8/2019 Morimoto ..... F24D 3/08
2019/0346153 A1* 11/2019 Morita ..... F24H 1/52

FOREIGN PATENT DOCUMENTS

DE 4034917 A1 * 5/1991 ..... F24H 9/0036
DE 9313023 U1 * 10/1993 ..... F24H 1/48
DE 4433387 A1 * 3/1995 ..... F24D 19/1069
DE 10048631 A1 * 4/2001 ..... F24H 1/205
EP 0421312 A2 * 4/1991 ..... F24D 19/1069
EP 0427121 A2 * 5/1991 ..... F24H 1/52
FR 2651870 A1 * 3/1991 ..... A47L 15/4285
JP 05045003 A * 2/1993
JP 2002022261 1/2002
JP 2005337632 12/2005
JP 2005337632 A * 12/2005
JP 2006112785 A * 4/2006
JP 2006153442 6/2006
JP 2015203509 11/2015
JP 5962303 8/2016
JP 2016146594 8/2016
WO WO-2004074744 A1 * 9/2004 ..... F24H 1/523
WO WO-2014104537 A1 * 7/2014 ..... F24D 19/0095

OTHER PUBLICATIONS

"International Search Report (Form PCT/ISA/210) of PCT/JP2017/038649," dated Nov. 28, 2017, with English translation thereof, pp. 1-4.

* cited by examiner

HEATING AND HOT WATER SUPPLYING DEVICE

CROSS-REFERENCE TO RELATED APPLICATION

This application is a 371 application of the international PCT application serial no. PCT/JP2017/038649, filed on Oct. 26, 2017, which claims the priority benefit of Japan application no. 2016-228811, filed on Nov. 25, 2016. The entirety of each of the above-mentioned patent applications is hereby incorporated by reference herein and made a part of this specification.

TECHNICAL FIELD

The present invention relates to a heating and hot water supplying device which performs heating by heating a heating medium using combustion heat and performs hot water supplying by heating tap water by heat exchange with the heating medium, and more particularly, to a heating and hot water supplying device capable of simultaneously performing a heating operation and a hot water supplying operation.

DESCRIPTION OF RELATED ART

A heating and hot water supplying device which can be switched between a heating operation and a hot water supplying operation has been widely used. Such a heating and hot water supplying device includes a combustion means, a heat exchanger, a circulation passage which connects the heat exchanger with a heating terminal installed in a room, a circulation pump which is provided in the circulation passage, a bypass passage which branches from the circulation passage and bypasses the heating terminal, and the like. A switching means which can be switched so that the heating medium flows through the circulation passage or the bypass passage is provided at a branching portion between the circulation passage and the bypass passage. A heat exchanger for hot water supply is provided in the bypass passage, and a water supply passage which supplies tap water to the heat exchanger for hot water supply and a hot water supply passage which supplies hot water from the heat exchanger for hot water supply to a hot water supply tap or the like are connected.

The heating medium which flows with an operation of the circulation pump is heated in the heat exchanger using combustion heat of the combustion means. In the heating operation, the switching means is switched so that the heating medium flows in the circulation passage to use the heated heating medium in the heating terminal. The heated heating medium flows through the circulation passage, releases heat at the heating terminal and returns to the heat exchanger.

In the hot water supplying operation, the switching means is switched so that the heating medium flows in the bypass passage so that the heated heating medium can be used in the heat exchanger for hot water supply. The tap water supplied from the water supply passage is heated by heat exchange with the heating medium in the heat exchanger for hot water supply. The heating medium which has exchanged heat with the tap water in the heat exchanger for hot water supply returns to the heat exchanger. Hot water heated by the heat exchanger for hot water supply is supplied from the hot water supply tap or the like via the hot water supply passage.

As described above, the heating and hot water supplying device which is switched between the heating operation and the hot water supplying operation is inconvenient due to a problem that it cannot simultaneously perform the heating operation and the hot water supplying operation.

Therefore, the applicant has already proposed a heating and hot water supplying device capable of a simultaneous heating and hot water supplying operation in which the heating operation and the hot water supplying operation are simultaneously performed by adjusting a distribution ratio of a distribution means of the heating medium (Japanese Patent Application No. 2016-146594 or the like). The heating and hot water supplying device capable of the simultaneous heating and hot water supplying operation determines whether the simultaneous heating and hot water supplying operation is possible on the basis of a tapping temperature and the like when hot water supply starts during the heating operation. If it is determined that the simultaneous operation is possible, the simultaneous heating and hot water supplying operation is performed, and if it is determined that the simultaneous operation is not possible, the hot water supplying operation is performed.

Further, although it is not a heating and hot water supplying device which supplies hot water heated by heat exchange with the heating medium, a heating and hot water supplying device with a bath reheating function of Patent Literature 1 which is configured so that bathwater may be heated by heat exchange with a heating medium is known. In this heating and hot water supplying device with the bath reheating function, when a temperature of the heating medium directed to the heating terminal falls below a reference temperature while the heating operation and a bath reheating operation are performed at the same time, a flow ratio of the heating medium distributed to the bath reheating operation and the heating operation is adjusted to give priority to either one.

PATENT DOCUMENT

[Patent Literature 1]
Japanese Patent No. 5962303

SUMMARY

Technical Problem

However, in this heating and hot water supplying device capable of the simultaneous heating and hot water supplying operation, when a hot water supply flow rate increases and a hot water supply load increases during the simultaneous heating and hot water supplying operation, a heating capacity for performing the simultaneous heating and hot water supplying operation may be insufficient. Further, there may be no room in the heating capacity for performing the simultaneous heating and hot water supplying operation in accordance with an environment and a climate in which the heating and hot water supplying device is installed, and thus the heating capacity may easily become insufficient.

The state in which the heating ability is insufficient is not preferable because it causes inconvenience or discomfort for a user of the hot water supply by lowering a flow rate of the hot water supply or providing hot water at a temperature lower than a hot water supply set temperature. Further, even when it is determined that the heating capacity is insufficient and priority is given to either one of the operations as in Patent Literature 1, there is a possibility that discomfort may be given until it is determined that the heating capacity is insufficient whenever the simultaneous heating and hot water supplying operation is performed.

An objective of the present invention is to provide a heating and hot water supplying device capable of each of a heating operation, a hot water supplying operation, and a simultaneous heating and hot water supplying operation, wherein the heating and hot water supplying device is capable of being set so that the simultaneous heating and hot water supplying operation is prohibited when it is determined that a heating capacity is insufficient to perform the simultaneous heating and hot water supplying operation.

Solution to Problem

According to a first invention, there is provided a heating and hot water supplying device including a combustion means, a heat exchanger, a circulation passage which connects the heat exchanger with an external heating terminal, a circulation pump which is provided in the circulation passage, a bypass passage which branches from the circulation passage and bypasses the heating terminal, a heat exchanger for hot water supply which is provided in the bypass passage, a water supply passage which supplies tap water to the heat exchanger for hot water supply, a hot water supply passage which supplies hot water heated by the heat exchanger for hot water supply at a preset hot water supply temperature, a control unit which controls operations in which the plurality of units are used, and an operation unit which is connected with the control unit to be able to communicate with the control unit and performs various operations, wherein a distribution means is provided in a branching portion of the bypass passage, the distribution means is able to adjust a distribution ratio so that each of a heating operation, a hot water supplying operation, and a simultaneous heating and hot water supplying operation is possible, and a prohibit switch which prohibits the simultaneous heating and hot water supplying operation is provided at the operation unit.

With such a configuration, the simultaneous heating and hot water supplying operation can be set to be prohibited by the operation of the prohibit switch. Accordingly, after the operation of the prohibit switch, a heating capacity for the simultaneous heating and hot water supplying operation does not become insufficient, and thus it is possible to reduce inconvenience or discomfort given to a user of the hot water supply.

According to a second invention, in the first invention, when it is determined that a heating capacity for performing the simultaneous heating and hot water supplying operation is insufficient while the simultaneous heating and hot water supplying operation is performed, a notification which prompts an operation of the prohibit switch may be performed.

With such a configuration, after it is determined that the heating capacity for performing the simultaneous heating and hot water supplying operation is insufficient, the operation of the prohibit switch can be prompted so that the heating capacity does not become insufficient. Therefore, it is advantageous to take measures to avoid the lack of the heating capacity.

According to a third invention, in the first or second invention, the heating and hot water supplying device may including an external air temperature detection means which detects an external air temperature, and when the external air temperature detected by the external air temperature detection means is equal to or higher than a predetermined reference temperature, the operation of the prohibit switch may be invalidated.

When the external air temperature is warmer than the reference temperature, a heating load is small. Therefore, since the heating capacity for the simultaneous heating and hot water supplying operation is not insufficient, it is not necessary to prohibit the simultaneous heating and hot water supplying operation. Therefore, according to the above-described configuration, when the external air temperature is equal to or higher than the reference temperature, the setting for permitting the simultaneous heating and hot water supplying operation can be maintained by setting the operation of the prohibit switch to be invalidated, and thus convenience can be improved.

According to a fourth invention, in the first to third inventions, the hot water supplying operation may be prioritized over the heating operation in a state in which the simultaneous heating and hot water supplying operation is prohibited by the operation of the prohibit switch.

With such a configuration, it is possible to reduce inconvenience or discomfort for a user of the hot water supply by giving priority to the hot water supplying operation.

Effects of Invention

According to the present invention, it is possible to provide a heating and hot water supplying device capable of performing each of a heating operation, a hot water supplying operation, and a simultaneous heating and hot water supplying operation. The heating and hot water supplying device is capable of being set so that the simultaneous heating and hot water supplying operation is prohibited when it is determined that a heating capacity is insufficient to perform the simultaneous heating and hot water supplying operation.

DESCRIPTION OF THE EMBODIMENTS

Hereinafter, the form for carrying out the present invention will be explained on the basis of an embodiment.

Figure 1:
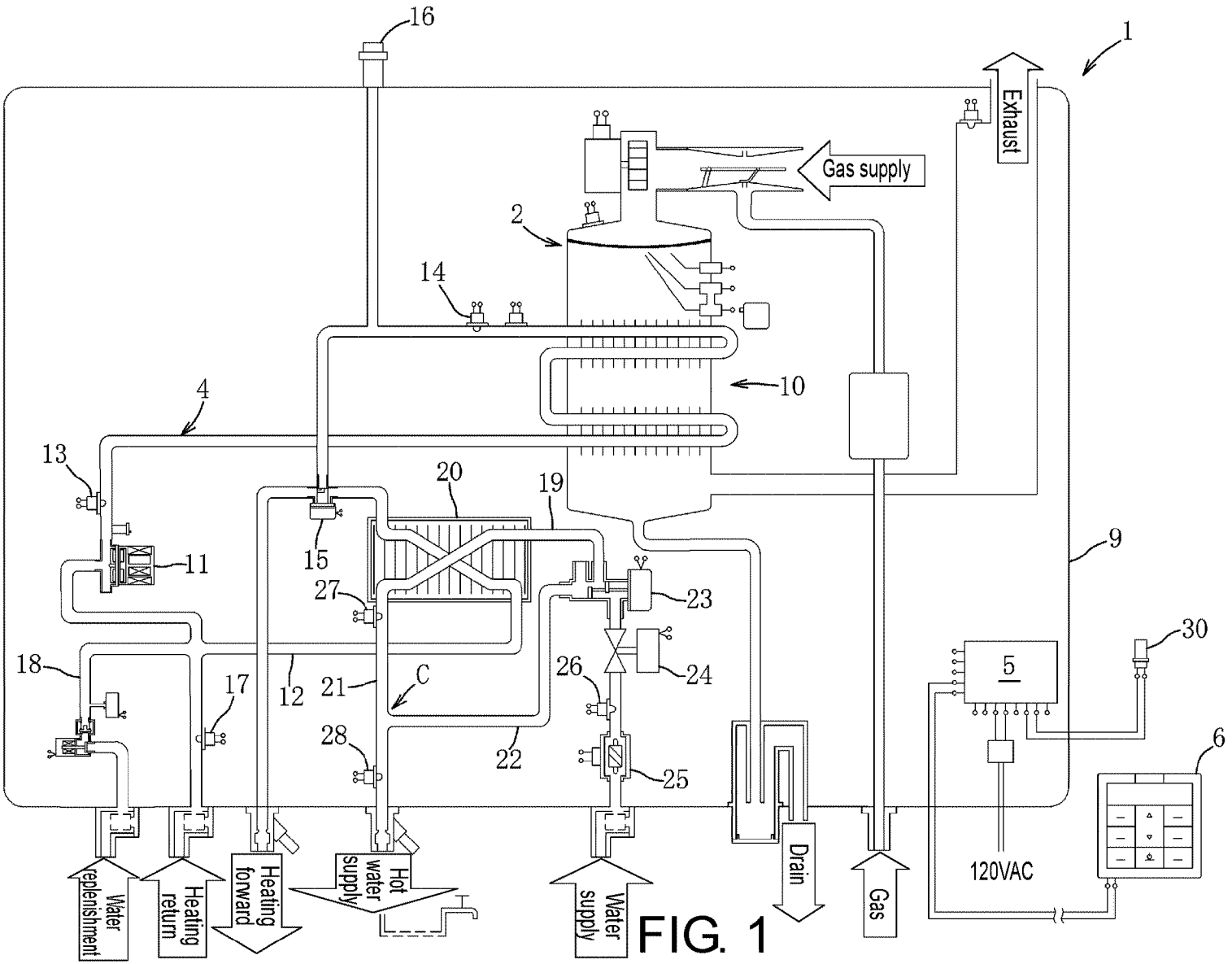
FIG. 1 is a schematic view of a heating and hot water supplying device of the present invention.

First, the entire configuration of a heating and hot water supplying device 1 of the present invention will be described with reference to FIG. 1.

The heating and hot water supplying device 1 is configured to perform a heating operation by circulating a heating medium heated using heat generated in a combustion unit 2 between a heating terminal (not shown) installed in a room outside the heating and hot water supplying device 1 and to perform a hot water supplying operation by adjusting a temperature of tap water heated using heat of the heating medium to a hot water supply set temperature.

The heating and hot water supplying device 1 includes the combustion unit 2 which is a combustion means, a heat exchanger 10, a circulation passage 4 which connects the heat exchanger 10 with a heating terminal provided in the room, and a circulation pump 11 provided on the upstream side of the circulation passage 4 from the heat exchanger 10. The combustion unit 2 mixes a fuel gas with air and burns it. The heat exchanger 10 exchanges heat between a combustion gas generated in the combustion unit 2 and the heating medium and heats the heating medium.

Also, the heating and hot water supplying device 1 includes a bypass passage (a first bypass passage 12), a heat exchanger 20 for hot water supply which is provided in the first bypass passage 12, a water supply passage 19, and a hot water supply passage 21. The first bypass passage 12 branches from the circulation passage 4 on the downstream side of the heat exchanger 10 to bypass the heating terminal and joins the circulation passage 4 on the upstream side of the circulation pump 11. The water supply passage 19 supplies tap water to the heat exchanger 20 for hot water supply. The hot water supply passage 21 supplies hot water heated by the heat exchanger 20 for hot water supply to a hot water supply tap or the like.

Furthermore, the heating and hot water supplying device 1 includes a control unit 5, and the above-described units including the control unit 5 are accommodated in a case 9. The control unit 5 receives a detection signal from a temperature sensor which will be described later and operates the circulation pump 11, a first distribution valve 15 or the like to control the heating operation, the hot water supplying operation, and so on. An operation terminal 6 which is an operation unit of the heating and hot water supplying device 1 is disposed in the room in which the heating terminal is installed. An external air temperature sensor 30 which is an external air temperature detection means is installed outdoors and connected to the control unit 5 to be able to communicate therewith.

Next, the circulation passage 4 will be described.

In the circulation passage 4, a first temperature sensor 13 is provided between the circulation pump 11 and the heat exchanger 10, and a second temperature sensor 14 is provided on the downstream side of the heat exchanger 10. The first temperature sensor 13 detects a temperature of the heating medium flowing into the heat exchanger 10. The second temperature sensor 14 detects a temperature of the heating medium heated by the heat exchanger 10.

The first distribution valve 15 which is a distribution means is provided at a branch portion between the circulation passage 4 and the first bypass passage 12. The first distribution valve 15 distributes the heating medium heated by the heat exchanger 10 to the circulation passage 4 and the first bypass passage 12, and a distribution ratio thereof can be adjusted.

A pressure release valve 16 which releases a pressure in the circulation passage 4 is provided between the heat exchanger 10 and the first distribution valve 15. A heating return temperature sensor 17 which detects a temperature of the heating medium returning from the heating terminal is provided on the upstream side of the circulation pump 11. A replenishment passage 18 which replenishes the heating medium is connected between the circulation pump 11 and the heating return temperature sensor 17.

Next, the heat exchange 20 for hot water supply will be described.

The heat exchanger 20 for hot water supply which is provided in the first bypass passage 12 is a plate type heat exchanger. In the plate type heat exchanger, a plurality of heat exchange plates are stacked, and a passage is formed between the heat exchange plates. In the heat exchanger 20 for hot water supply, the heating medium and the tap water supplied from the water supply passage 19 flow alternately in the passages between the heat exchange plates to face each other without being mixed with each other. In these heat exchange plates, irregularities are formed to expand a surface area and to improve heat exchange efficiency.

Next, the water supply passage 19 and the hot water supply passage 21 will be described.

A second distribution valve 23, a flow rate adjustment valve 24, a hot water supply flow rate sensor 25, and an inflow water temperature sensor 26 are provided in the water supply passage 19. The second distribution valve 23 distributes the tap water to the water supply passage 19 and a hot water supply bypass passage (a second bypass passage 22) branched from the water supply passage 19 in the second distribution valve 23, and a distribution ratio thereof can be adjusted. Therefore, the second distribution valve 23 is a flow rate adjustment means which adjusts a flow rate of the tap water flowing through the second bypass passage 22. The flow rate adjustment valve 24 adjusts the flow rate of the tap water flowing into the second distribution valve 23. The hot water supply flow rate sensor 25 detects an adjusted flow rate of the tap water. The inflow water temperature sensor 26 detects a temperature of the tap water flowing into the second distribution valve 23.

The hot water supply passage 21 joins the second bypass passage 22 at a joining portion C. A tapping temperature sensor 27 which is a temperature detection means is provided between the joining portion C and the heat exchanger 20 for hot water supply. The tapping temperature sensor 27 detects a temperature of hot water discharged from the heat exchanger 20 for hot water supply.

A hot water supply temperature sensor 28 is provided at a downstream end of the hot water supply passage 21. The hot water supply temperature sensor 28 detects a hot water supply temperature of hot water that is a mixture of hot water heated by the heat exchanger 20 for hot water supply and the tap water flowing through the second bypass passage 22.

Next, the control unit 5 and the operation terminal 6 will be described.

Figure 2:
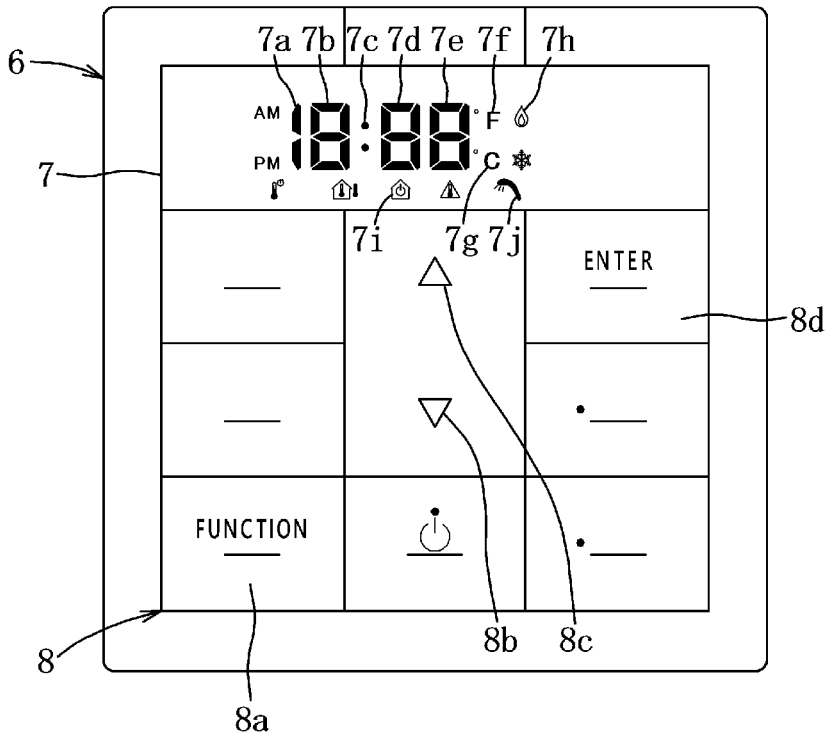
FIG. 2 is a front view of an operation terminal.

Although not shown, the control unit 5 is connected to be able to receive detection signals from the temperature sensor and so on provided in the heating and hot water supplying device 1 and to be able to control the circulation pump 11, the first distribution valve 15 and the like. The operation terminal 6 disposed in the room is connected to the control unit 5 to be able to communicate therewith. As shown in FIG. 2, the operation terminal 6 includes a display means 7 capable of displaying, for example, a temperature, an operation state and the like, a switch unit 8 which performs a setting operation of the heating temperature or the hot water supply temperature and a start operation of the heating operation and the like, and an audio output unit (not shown) which outputs an alarm sound and the like.

The display means 7 includes a display 7*a* of a numeral "1," three 7-segment displays 7*b*, 7*d* and 7*e* on the right of the display 7a, and a display unit 7*c* of a symbol ":" (colon) between the 7-segment displays 7*b* and 7*d*. The 7-segment displays 7*b*, 7*d* and 7*e* can display the numbers 0 to 9 or letters.

Further, the display means 7 includes a Fahrenheit display unit 7*f* and a Celsius display unit 7*g* which display temperature units, a combustion display unit 7*h* which displays combustion of the combustion unit 2, a heating display unit 7*i* which displays the heating operation, a hot water supply display unit 7*j* which displays the hot water supplying operation, and the like. The heating display unit 7*i* is displayed, for example, in orange while the first distribution valve 15 distributes and circulates the heating medium to the circulation passage 4 side. The hot water supply display unit 7*j* is displayed, for example, in orange while the hot water supply flow rate sensor 25 provided in the hot water supply passage 21 detects a flow rate equal to or more than a predetermined flow rate.

A plurality of switches 8 including a function switch 8*a* which switches setting items, selection switches 8*b* and 8*c* which select options, numerical values or the like in the setting items, an input switch 8*d*, and so on are provided in the switch unit 8. Each of the switches is a push type switch, but a rotary type or slide type switch may be provided.

Figure 3:
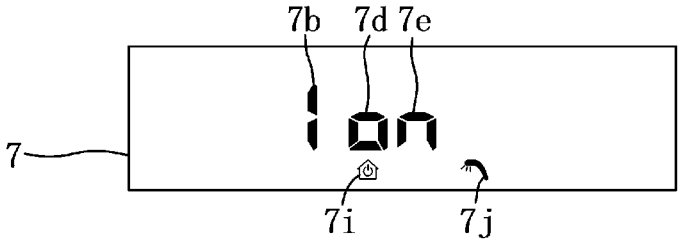
FIG. 3 is a view showing an example of displaying of setting for permitting a simultaneous heating and hot water supplying operation when a prohibit switch is operated.

The function switch 8*a* switches states of the plurality of setting items of the heating and hot water supplying device 1 one by one for each operation and displays the states on the display means 7. For example, when the function switch 8*a* is operated once, as shown in FIG. 3, a setting item number "1" indicating setting for the simultaneous heating and hot water supplying operation is displayed on the 7-segment display 7*b*, and "on" indicating setting for permitting the simultaneous heating and hot water supplying operation is displayed in the 7-segment displays 7*d* and 7*e*. At this time, the heating display unit 7*i* and the hot water supply display unit 7*j* corresponding to the setting items may be displayed, and the displaying may be blinked during a setting change operation.

Figure 4:
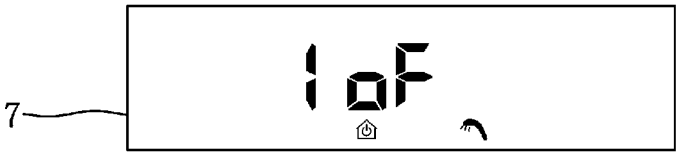
FIG. 4 is a view showing an example of displaying of the setting for prohibiting the simultaneous heating and hot water supplying operation when the prohibit switch is operated.

When the selection switch 8*b* or the selection switch 8*c* is operated once, as shown in FIG. 4, "oF" (meaning "off") indicating setting for prohibiting the simultaneous heating and hot water supplying operation is displayed on the 7-segment displays 7*d* and 7*e*. When the input switch 8*d* is operated, the changed setting is reflected, and the displaying returns to, for example, a heating set temperature or the like. By the same operation, the setting for prohibiting the simultaneous heating and hot water supplying operation can be changed to the setting for permitting the simultaneous heating and hot water supplying operation.

Thus, although a prohibit switch which prohibits the simultaneous heating and hot water supplying operation is constituted by combining the plurality of switches, a dedicated prohibit switch for setting the prohibition of the simultaneous heating and hot water supplying operation may be provided. Further, the display means 7 may be a display device capable of displaying the same content as the above-described display content, for example, a dot matrix type liquid crystal display device, or the like and the switch unit 8 may also be configured to be displayed on the display means 7 and to be touchable.

Next, the operation and effect of the heating and hot water supplying device 1 will be described with reference to FIGS. 1 and 2.

In the heating and hot water supply device 1, here, it is the setting for permitting the simultaneous heating and hot water supplying operation, and it is assumed that the heating operation is being performed. At this time, the heating set temperature is displayed and the combustion display unit 7*h* and the heating display unit 7*i* are displayed on the display means 7.

When the hot water supply flow rate sensor 25 detects a flow rate equal to or higher than a predetermined flow rate during the heating operation due to opening of the hot water supply tap or the like, the hot water supplying operation starts. The control unit 5 adjusts the first distribution valve 15 to circulate the heating medium only to the first bypass passage 12. Hot or cold water to be supplied is heated by heat exchange with the heating medium in the heat exchanger 20 for hot water supply. Further, the control unit 5 adjusts the distribution ratio of the second distribution valve 23 to supply the hot water having the hot water supply set temperature. Therefore, it is possible to quickly perform the hot water supply at the hot water supply set temperature. At this time, the hot water supply set temperature and the hot water supply display unit 7*j* are displayed on the display means 7, and the heating display unit 7*i* is not displayed.

The control unit 5 determines whether the simultaneous heating and hot water supplying operation is possible on the basis of the hot water supply set temperature, the tapping temperature detected by the tapping temperature sensor 27, and the like. When it is determined that the simultaneous heating and hot water supplying operation is not possible, the hot water supplying operation is performed as it is, and when use of the hot water is finished, the heating operation is returned.

On the other hand, when it is determined that the simultaneous heating and hot water supplying operation is possible, the distribution ratio of the first distribution valve 15 is adjusted to distribute the heating medium to the heating terminal side. At this time, the heating display unit 7*i* is displayed again on the display means 7, and it is displayed that simultaneous heating and hot water supplying operation is being performed by simultaneously displaying the hot water supply display unit 7*j*. Further, although the hot water supply set temperature and the heating set temperature are alternately displayed on the display means 7, it may be selectable to display either one.

During the simultaneous heating and hot water supplying operation, the heating capacity is determined on the basis of the distribution ratio of the first distribution valve 15. When the hot water supply flow rate increases during the simultaneous heating and hot water supplying operation, the first distribution valve 15 increases the heating medium distributed to the first bypass passage 12 on the hot water supply side and reduces the heating medium distributed to the circulation passage 4 on the heating side to prevent a decrease in the hot water supply temperature. When a state in which the heating side is smaller than a predetermined distribution ratio (for example, the heating side:the hot water supply side=1:9) continues for a predetermined period (for example, 3 seconds) or more, it is determined that the heating capacity is insufficient.

On the other hand, when the heating set temperature is raised during the simultaneous heating and hot water supplying operation, or when a room temperature falls sharply, the heating load becomes large. At this time, the first distribution valve 15 increases the heating medium distributed to the circulation passage 4 on the heating side and reduces the heating medium distributed to the first bypass passage 12 on the hot water supply side. When a state in which the hot water supply side is smaller than a predetermined distribution ratio (for example, the heating side:the hot water supply side=1:9) continues for a predetermined period (for example, 3 seconds) or more, it is determined that the heating capacity is insufficient.

When it is determined that the heating capacity is insufficient for the simultaneous heating and hot water supplying operation, the hot water supplying operation is prioritized. At this time, in the operation terminal 6, for example, the heating display unit 7*i* of the display means 7 is displayed in red, and sound or the like is output. In this way, a user of the heating and the hot water supply is notified of the state in which the heating capacity for performing the simultaneous heating and hot water supplying operation is insufficient to urge the user to operate the prohibit switch for setting the prohibition of the simultaneous heating and hot water supplying operation to avoid this state. Since the guidance is provided not to cause the heating capacity to be insufficient, it is advantageous for the user of the hot water supply or the heating to take measures for avoiding the lack of heating capacity. Also, in addition to the operation of the prohibit switch, the user can take measures for stopping the heating operation, reducing the hot water supply flow rate, or the like.

On the other hand, when there is no room in the heating capacity for the simultaneous heating and hot water supplying operation in accordance with the installation environment or the climate, once it is determined that the heating capacity is insufficient, it is expected that the heating capacity is determined to be insufficient whenever the simultaneous heating and hot water supplying operation is performed. In this case, since it is possible to prohibit the simultaneous heating and hot water supplying operation by operating the prohibit switch, after the simultaneous heating and hot water supplying operation is prohibited, the hot water supplying operation is prioritized, it is not determined that the heating capacity is insufficient, and it is possible to reduce the inconvenience or discomfort given to the user of the hot water supply. Further, there is no inconvenience or discomfort to the user due to the notification to the user performed whenever it is determined that the heating capacity is insufficient. Furthermore, when the hot water supply is used, it is possible to allow a sufficient heating capacity to cope with an increase in the hot water supply flow rate.

When the external air temperature detected by the external air temperature sensor 30 is equal to or higher than a predetermined reference temperature, the heating load is reduced, and thus the lack of the heating capacity for the simultaneous heating and hot water supplying operation hardly occurs. Therefore, it is not necessary to prohibit the simultaneous heating and hot water supplying operation. Thus, when the external air temperature is equal to or higher than a predetermined reference temperature, even when the prohibit switch is operated, the operation thereof is invalidated, and the state in which the simultaneous heating and hot water supplying operation is permitted can be maintained. The operation of the prohibit switch for changing the simultaneous heating and hot water supplying operation to the permitted state is not invalidated.

Next, an example in which the above-described embodiment is partially modified will be described.

[1] A time period for permitting the simultaneous heating and hot water supplying operation or a time period for prohibiting the same may be set so that the simultaneous heating and hot water supplying operation is prohibited in a time period in which the heating capacity is likely to be insufficient. With such a configuration, the simultaneous heating and hot water supplying operation may be prohibited, for example, in the morning time when the heating load and the hot water supply load increase, and thus it is possible to reduce the inconvenience or discomfort for the user of the hot water.

[2] The heating capacity may be determined in a state in which the simultaneous heating and hot water supplying operation starts without determining whether the simultaneous heating and hot water supplying operation is possible.

[3] In addition, those skilled in the art can implement the embodiment in various modifications without departing from the spirit of the present invention, and the present invention includes such modifications.

What is claimed is:

1. A heating and hot water supplying device comprising:

a combustion means;

a heat exchanger;

a circulation passage which connects the heat exchanger with an external heating terminal;

a circulation pump which is provided in the circulation passage;

a bypass passage which branches from the circulation passage and bypasses the heating terminal;

a heat exchanger for hot water supply which is provided in the bypass passage;

a water supply passage which supplies tap water to the heat exchanger for hot water supply;

a hot water supply passage which supplies hot water heated by the heat exchanger for hot water supply at a preset hot water supply temperature;

a control unit which controls operations comprising a heating operation and a hot water supplying operation;

an operation terminal which is connected with the control unit to be able to communicate with the control unit and performs various operations; and an external air temperature sensor which detects an external air temperature, wherein a distribution valve is provided in a branching portion of the bypass passage, the distribution valve is able to adjust a distribution ratio so that each of the heating operation, the hot water supplying operation, and a simultaneous heating and hot water supplying operation is possible, and a prohibit switch which prohibits the simultaneous heating and hot water supplying operation is provided at the operation terminal, and wherein when the external air temperature detected by the external air temperature sensor is equal to or higher than a predetermined reference temperature, an operation of the prohibit switch is invalidated.

2. The heating and hot water supplying device according to claim 1, wherein, when it is determined that a heating capacity for performing the simultaneous heating and hot water supplying operation is insufficient while the simultaneous heating and hot water supplying operation is performed, a notification which prompts the operation of the prohibit switch is performed.

3. The heating and hot water supplying device according to claim 2, wherein the hot water supplying operation is prioritized over the heating operation in a state in which the simultaneous heating and hot water supplying operation is prohibited by the operation of the prohibit switch.

4. The heating and hot water supplying device according to claim 1, wherein the hot water supplying operation is prioritized over the heating operation in a state in which the simultaneous heating and hot water supplying operation is prohibited by the operation of the prohibit switch.

* * * * *